US007562478B1

(12) United States Patent
Vastag

(10) Patent No.: US 7,562,478 B1
(45) Date of Patent: Jul. 21, 2009

(54) FIREARM CONVERSION SYSTEM AND CALIBER REDUCER WITH HAMMER SAFETY LOCK

(76) Inventor: Laszlo Vastag, 279 Souer Rd., Stamford, NY (US) 12167

( * ) Notice: Subject to any disclaimer, the term of this patent is extended or adjusted under 35 U.S.C. 154(b) by 0 days.

(21) Appl. No.: 12/009,859

(22) Filed: Jan. 23, 2008

Related U.S. Application Data

(60) Provisional application No. 60/897,157, filed on Jan. 24, 2007.

(51) Int. Cl.
*F41C 3/14* (2006.01)
*F41A 21/10* (2006.01)

(52) U.S. Cl. ..... 42/59; 42/51; 42/77

(58) Field of Classification Search ..... 89/36.01, 89/36.02, 36.03, 36.04, 36.07, 36.08, 36.09, 89/36.12, 36.17; 42/188, 304.4, 313.3, 314.2, 42/321.5, 457, 91, 51, 59, 68, 77
See application file for complete search history.

(56) References Cited

U.S. PATENT DOCUMENTS 2,150,914 A * 3/1939 Gaidos ..... 42/59
2,238,587 A * 4/1941 Gaidos ..... 42/59
2,976,638 A * 3/1961 Owens ..... 42/77
4,455,777 A * 6/1984 Callies ..... 42/59
4,735,009 A * 4/1988 Jett, Jr. ..... 42/77
4,989,359 A * 2/1991 Kinkner et al. ..... 42/77
6,029,385 A * 2/2000 Howell, Jr. ..... 42/59
6,047,490 A * 4/2000 Kirst ..... 42/59
6,513,274 B1 * 2/2003 Vastag ..... 42/77
6,634,128 B1 * 10/2003 Vastag ..... 42/59
2002/0078614 A1 * 6/2002 Kornberger ..... 42/59
2005/0028421 A1 * 2/2005 Saxby et al. ..... 42/77
2007/0006508 A1 * 1/2007 Baker et al. ..... 42/71.02

* cited by examiner

*Primary Examiner*—Bret Hayes

(57) ABSTRACT

A pistol has a forwardly extending cylindrical shaft with a cylindrical bearing surface. A rotatable cylinder is mounted on the bearing surface. A cylindrical chamber in the rotatable cylinder receives a cartridge. A firing pin ring with a firing pin aligned with the chamber is mounted on the bearing surface. A hammer safety lock includes a hole in the firing pin ring with a rearwardly extending pin. A barrel receives the cylindrical shaft. A barrel sleeve is positioned between the barrel and the shaft. A cartridge extraction tool is operable after axial sliding and separation between the cylinder and the cylindrical shaft. The cartridge extraction tool is adapted to be inserted into the chamber of the cylinder from the end remote from the firing pin ring to remove a cartridge.

6 Claims, 8 Drawing Sheets

FIG 1
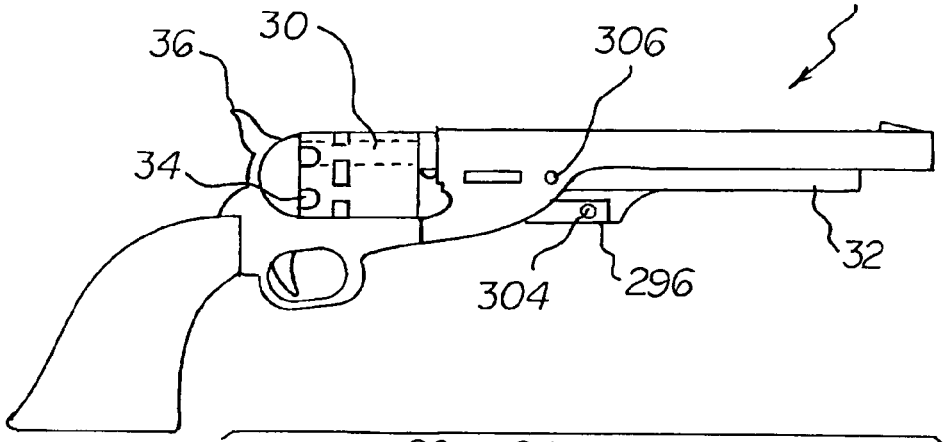
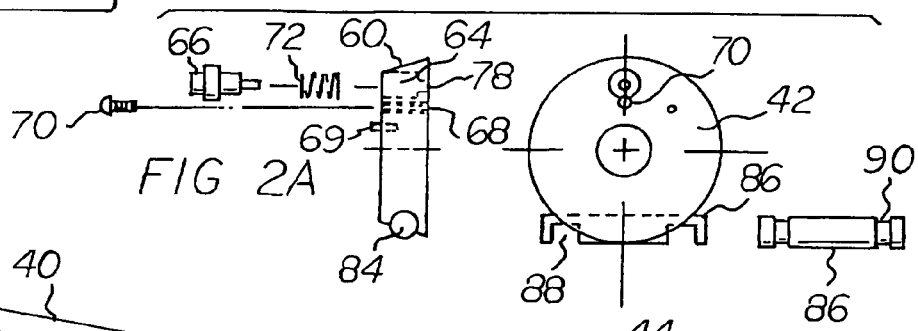
FIG 2A
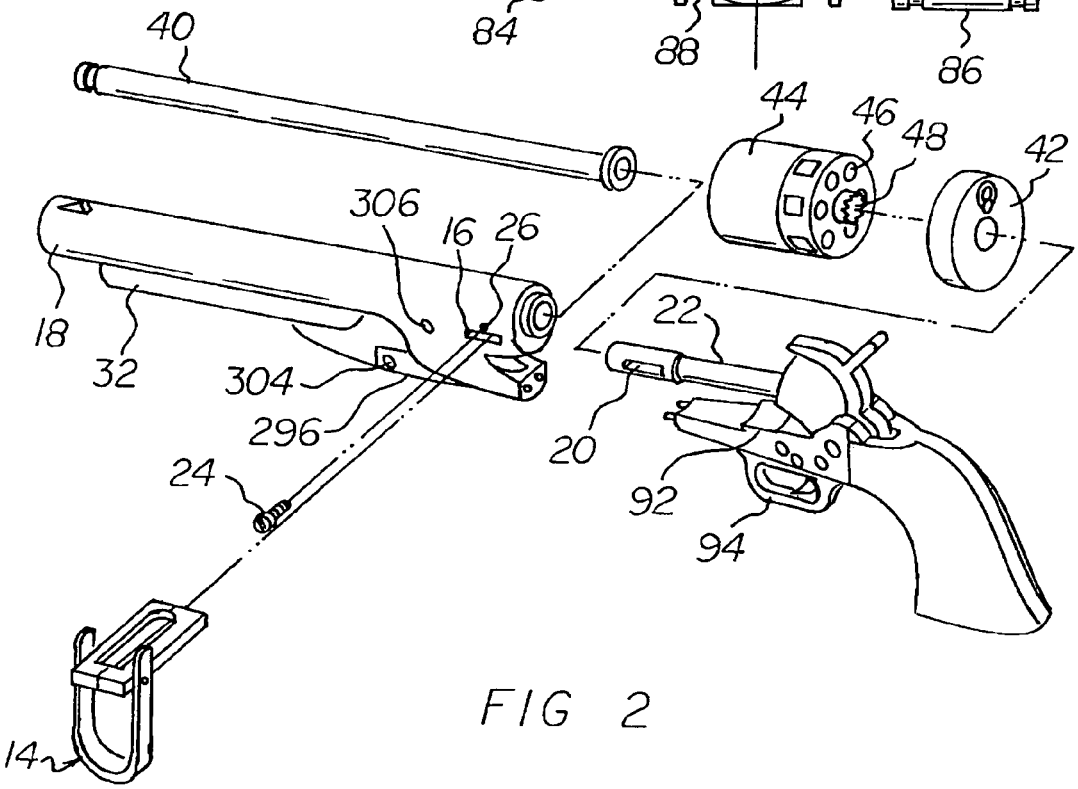
FIG 2

FIG 3
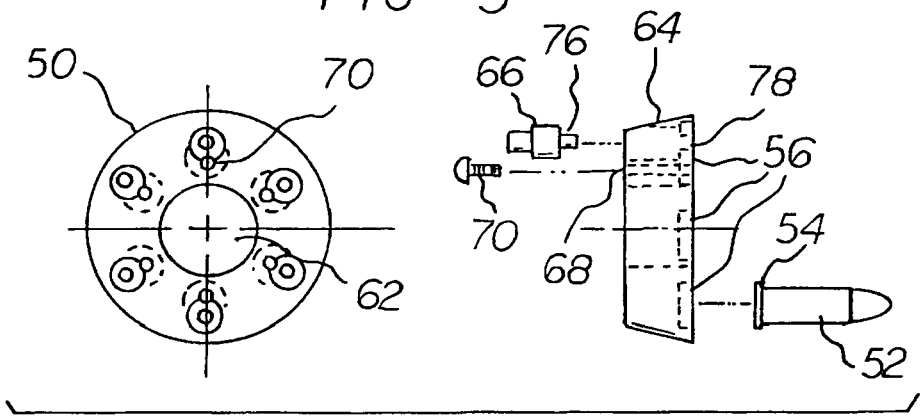
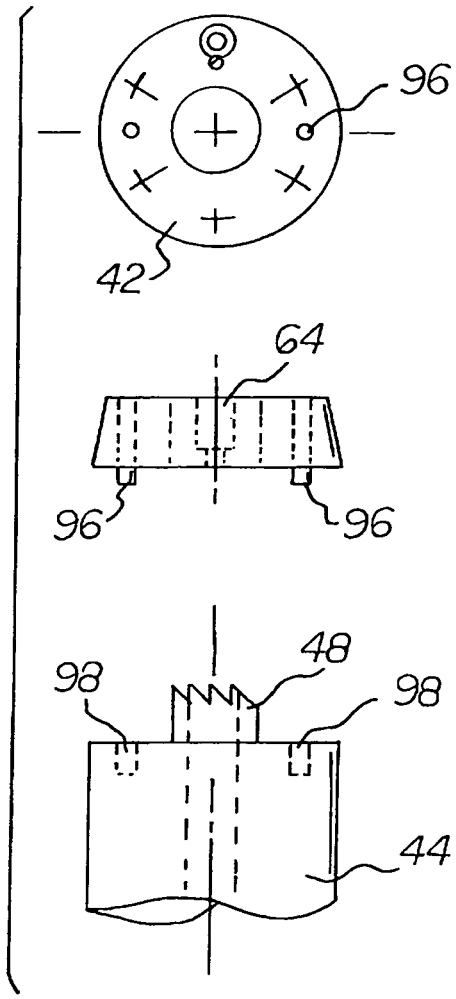
FIG 4
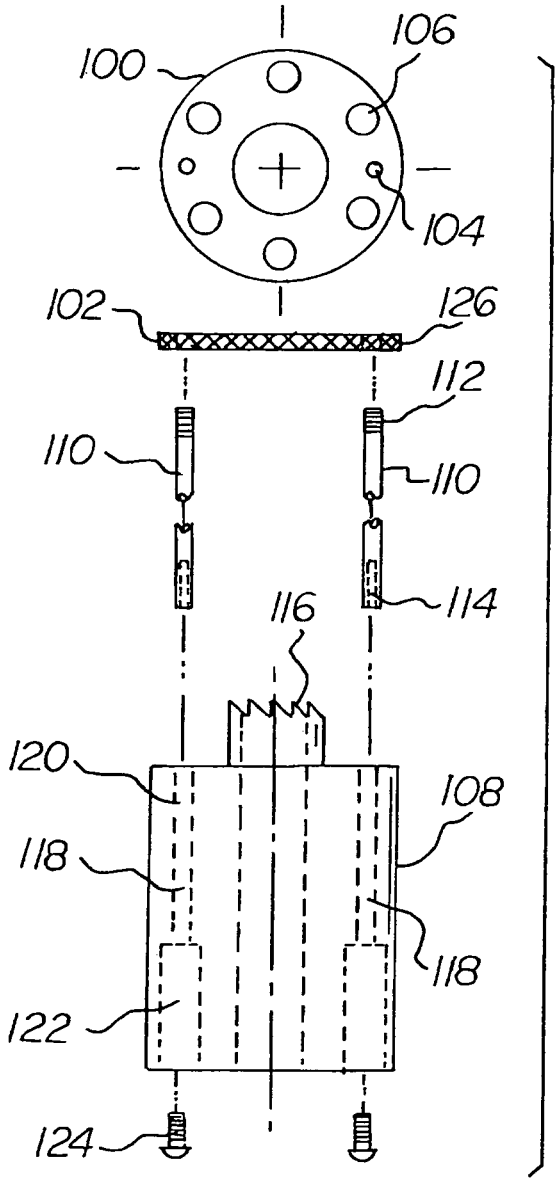
FIG 5

FIG 6
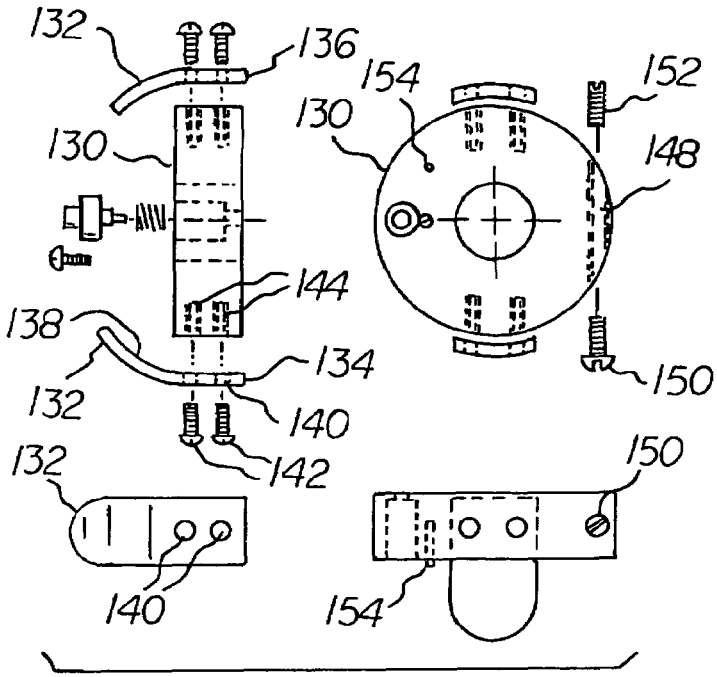
FIG 7
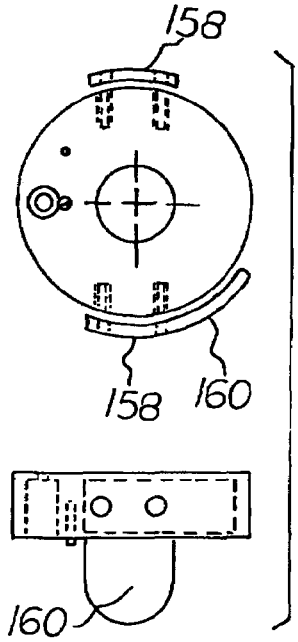
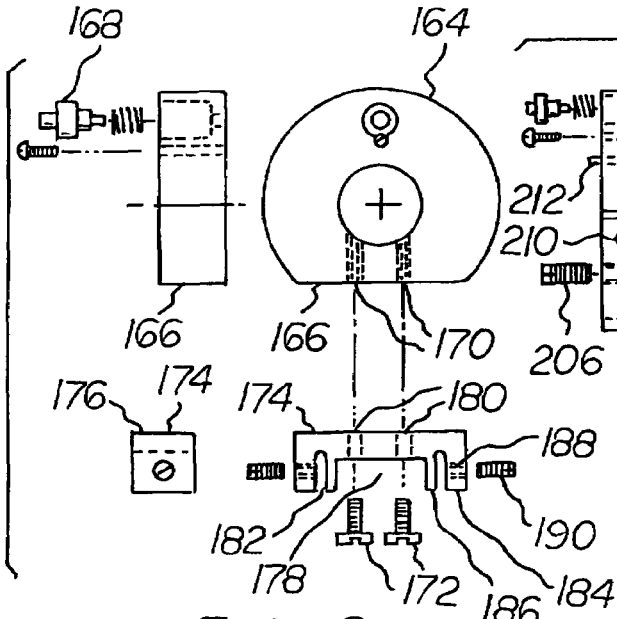
FIG 8
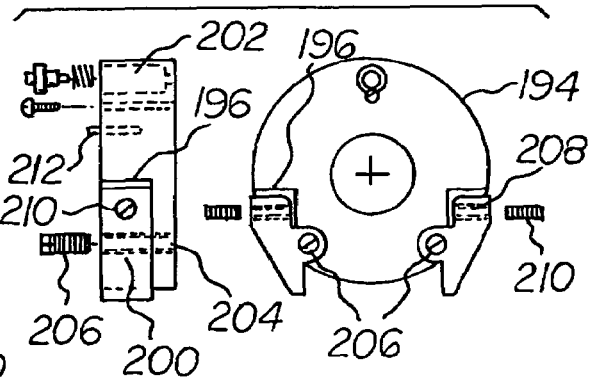
FIG 9

224
216
226
220
222
224
228
218

232
234
236

240
242
244
245

252
254
256
258
260
262
264

274
270
268
272
276
280
278
282

312
310

298
300
304
292
300
304
294

502
504
508
506

520
518
514
522
520
528
516
526
524

FIG 20
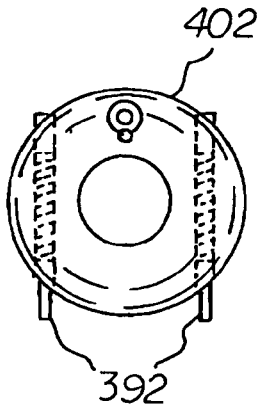
FIG 21
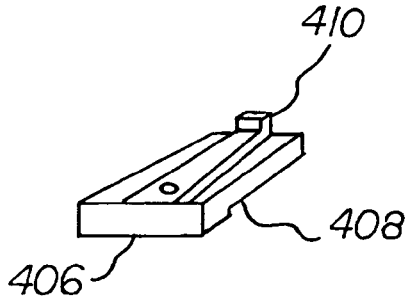
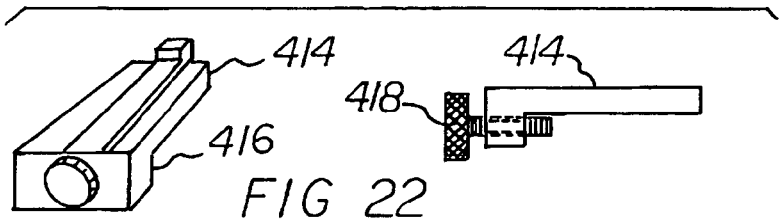
FIG 22
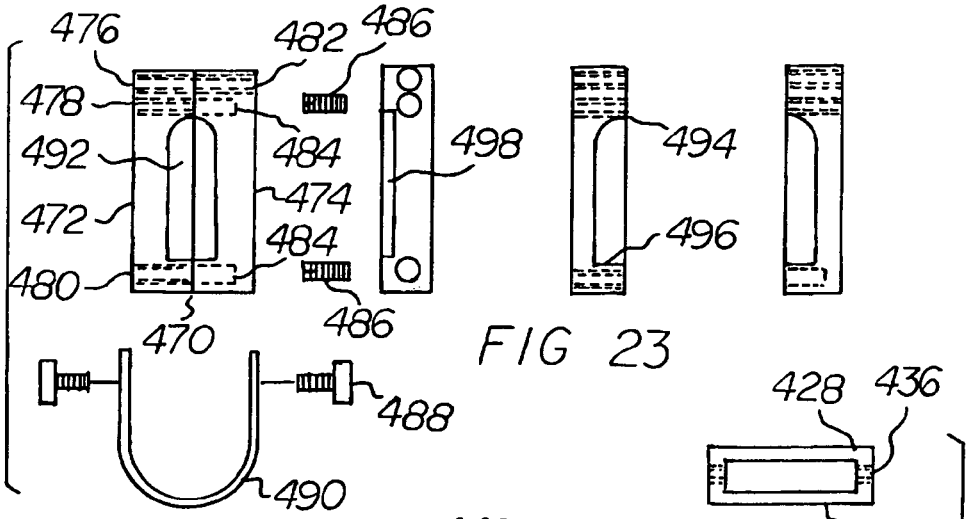
FIG 23
FIG 24

FIG 25
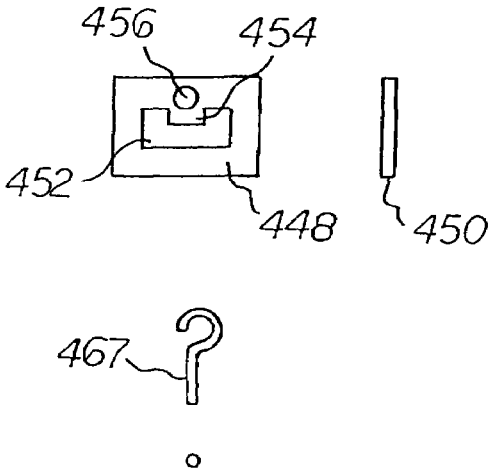
FIG 26
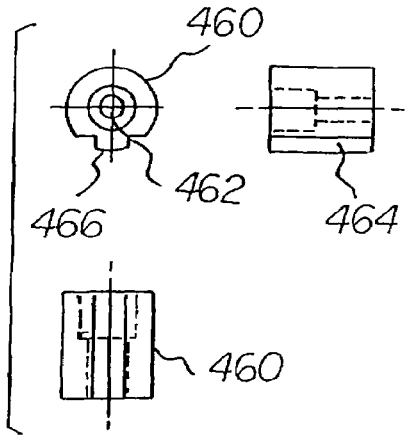
FIG 27
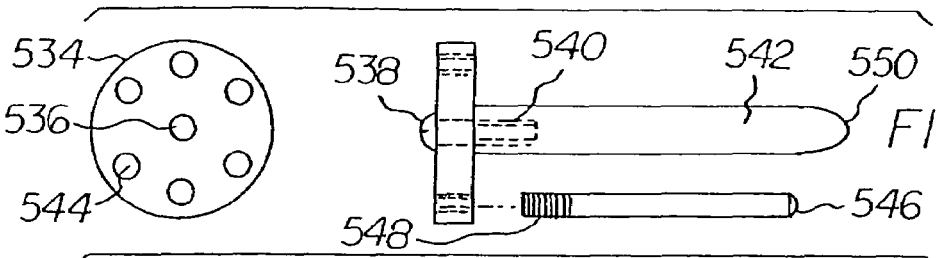
FIG 28
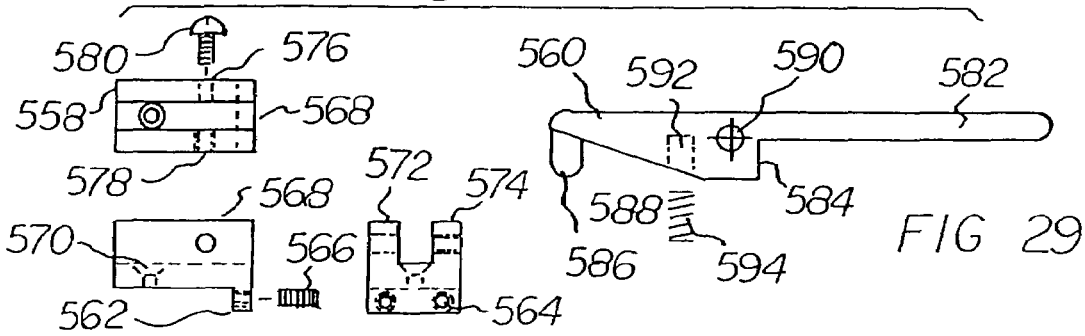
FIG 29
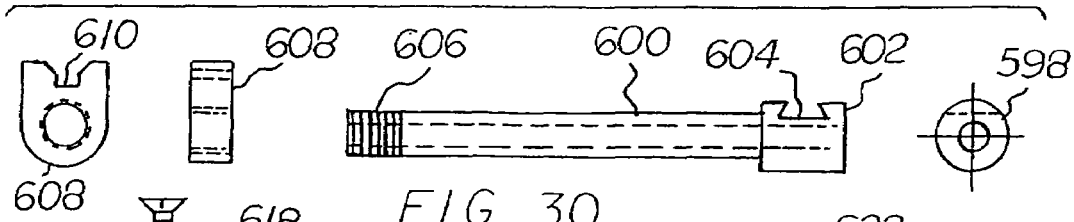
FIG 30
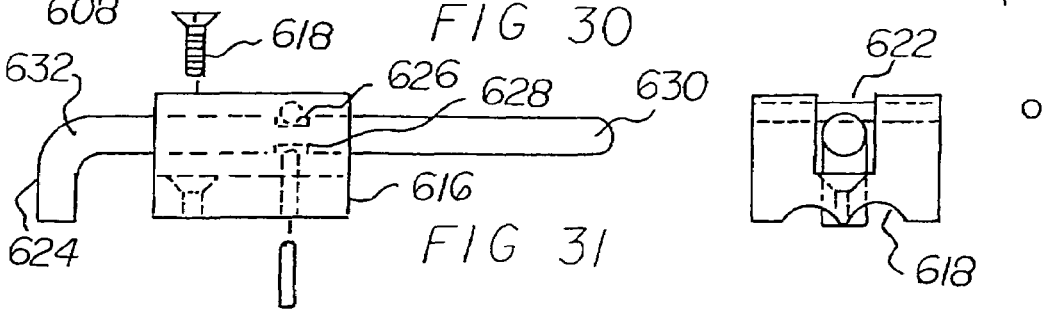
FIG 31

FIREARM CONVERSION SYSTEM AND CALIBER REDUCER WITH HAMMER SAFETY LOCK

RELATED APPLICATION

This application claims the benefit of Provisional Application Ser. No. 60/897,157 filed Jan. 24, 2007 the subject matter of which is incorporated herein by reference.

BACKGROUND OF THE INVENTION

1. Field of the Invention

The present invention relates to a firearm conversion system and more particularly pertains to converting a revolver normally loaded with black powder and ball to a revolver for rapidly firing metallic cartridges.

2. Description of the Prior Art

The use of firearm conversation systems of known designs and configurations are known in the prior art. More specifically, firearm conversation systems of known designs and configurations previously devised and utilized for the purpose of converting black powder and ball revolvers to fire metallic cartridges are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,513,274 to Vastag issued Feb. 4, 2003, discloses a removable system for converting a breach loading shotgun to a .22 long rifle. Also, U.S. Pat. No. 6,634,128 to Vastag issued Oct. 21, 2005, discloses a .22 caliber long rifle removable conversion system kit for black powder cap and ball reproduction and replica revolver—recreation and gallery shooting.

While these devices fulfill their respective, particular objectives and requirements, the aforementioned patents do not describe a firearm conversion system that allows converting a revolver normally loaded with black powder and ball to a revolver for rapidly firing metallic cartridges.

In this respect, the firearm conversion system according to the present invention substantially departs from the conventional concepts and designs of the prior art, and in doing so provides an apparatus primarily developed for the purpose of converting a revolver normally loaded with black powder and ball to a revolver for rapidly firing metallic cartridges.

Therefore, it can be appreciated that there exists a continuing need for a new and improved firearm conversion system which can be used for converting a revolver normally loaded with black powder and ball to a revolver for rapidly firing metallic cartridges. In this regard, the present invention substantially fulfills this need.

SUMMARY OF THE INVENTION

In view of the foregoing disadvantages inherent in the known types of firearm conversation systems of known designs and configurations now present in the prior art, the present invention provides an improved firearm conversion system. As such, the general purpose of the present invention, which will be described subsequently in greater detail, is to provide a new and improved firearm conversion system and method which has all the advantages of the prior art and none of the disadvantages.

To attain this, the present invention essentially comprises a firearm conversion system for converting a revolver normally loaded with black powder and ball for rapidly firing metallic cartridges. First provided is an open top frame. The open top frame has a central extent with an upwardly extending hammer pivotable forwardly for striking a firing pin to strike and discharge a metallic cartridge. The central extent has an operator controlled trigger extending downwardly for initiating movement of the hammer. The central extent has a rearwardly extending handle and a forwardly extending cylindrical shaft. The cylindrical shaft has a diametric slot spaced from the central extent with a cylindrical bearing surface between the slot and the central extent.

Next provided is a rotatable cylinder. The rotatable cylinder has a central axial aperture mounted on the bearing surface of the cylindrical shaft, the rotatable cylinder having six cylindrical chambers axially oriented and equally spaced around the periphery of the rotatable cylinder.

Next provided is a rotatable firing pin ring having a central axial aperture. The firing pin ring is mounted on the bearing surface of the cylindrical shaft between the central extent and the rotatable cylinder. The firing pin ring has six cylindrical bores aligned with the chambers of the rotatable cylinder.

Six firing pins are provided. One firing pin is within each one of the bores and each firing pin is adapted to axially shift when struck by the hammer to strike and discharge one of the metallic cartridges within one of the a chambers of the rotatable cylinder. A hammer safety lock is provided. It includes a hole in the firing pin ring with a rearwardly extending pin.

Six cylindrical recesses are provided. One of the recesses is within each bore and is in communication with an associated one of the chambers.

Next provided are a metallic cartridges. One cartridge is in each chamber. Each cartridge has a forward end removably positioned in one of the chambers and a rearward end removably received within one of the recesses. In this manner, the cartridges will insure concurrent rotation of the cylinder and the firing pin ring during operation and use.

Next provided is a barrel having a central bore with an interior end receiving the cylindrical shaft and an exterior end. The barrel has a diametric slot positionable in alignment with the diametric slot of the cylindrical shaft.

Next provided is a barrel sleeve in a cylindrical configuration. The barrel sleeve is positioned between the barrel and the shaft.

Next provided is a barrel wedge. The barrel wedge is movable by a user between an operative orientation and an inoperative orientation. In the operative orientation the barrel wedge is within the slots of the barrel and the shaft for securement purposes. In the inoperative orientation the barrel wedge is removed from the slots for disassembly purposes.

Lastly, a cartridge extraction tool assembly attached to the side of the gun is provided. The cartridge extraction tool is operable with the barrel wedge pulled and with the barrel and barrel sleeve separated from the frame and with the cylinder and firing pin ring axially slid from the cylindrical shaft. This procedure is for an open top gun. For a solid frame gun, the cylinder shaft should be pulled and the gun's barrel does not come off. The cartridge extraction tool is adapted to be sequentially inserted into the chambers of the cylinder from the end remote from the firing pin ring to remove the cartridges after firing in anticipation of reloading the chambers and recesses with new cartridges.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved firearm conversion system which has all of the advantages of the prior art firearm conversation systems of known designs and configurations and none of the disadvantages.

It is another object of the present invention to provide a new and improved firearm conversion system which may be easily and efficiently manufactured and marketed.

It is further object of the present invention to provide a new and improved firearm conversion system which is of durable and reliable constructions.

An even further object of the present invention is to provide a new and improved firearm conversion system which is susceptible of a low cost of manufacture with regard to both materials and labor, and which accordingly is then susceptible of low prices of sale to the consuming public, thereby making such firearm conversion system economically available to the buying public.

Even still another object of the present invention is to provide a firearm conversion system for converting a revolver normally loaded with black powder and ball to a revolver for rapidly firing metallic cartridges.

Lastly, it is an object of the present invention to provide a new and improved firearm conversion system wherein a pistol has a forwardly extending cylindrical shaft with a cylindrical bearing surface. A rotatable cylinder is mounted on the bearing surface. A cylindrical chamber in the rotatable cylinder receives a cartridge. A firing pin ring with a firing pin aligned with the chamber is mounted on the bearing surface. A hammer safety lock includes a hole in the firing pin with a rearwardly extending pin. A barrel receives the cylindrical shaft. A barrel sleeve is positioned between the barrel and the shaft. A cartridge extraction tool is operable after axial sliding and separation between the cylinder and the cylindrical shaft. The cartridge extraction tool is adapted to be inserted into the chamber of the cylinder from the end remote from the firing pin ring to remove a cartridge.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of an open top firearm conversion system constructed in accordance with the principles of the present invention;

FIG. 2 is an exploded perspective illustration of the firearm conversion system of FIG. 1.

FIG. 2A is an exploded side elevational view of the firing pin ring of FIG. 2 and a front elevational view thereof along with an alternate embodiment of the invention.

FIG. 3 is an exploded side elevational view of a firing pin ring and a front elevational view.

FIGS. 4 and 5 are exploded side elevational views of firing pin rings with cylinders constructed as alternate embodiments as well as front elevational views.

FIGS. 6 and 7 are firing pin rings with safety lock features constructed in accordance with alternate embodiments.

FIGS. 8 and 9 are firing pin rings with coupling features constructed in accordance with alternate embodiments.

FIGS. 17 through 20 are end and side and exploded views of alternate firing pin rings.

FIGS. 21 through 24 are end and side and exploded views of alternate barrel wedges.

FIGS. 25, 26 and 15C are alternate special washers for the barrel wedge.

FIG. 27 is a front and end view of an alternate embodiment safety for the barrel wedge.

FIG. 28 is an exploded side view and an end view of a quick unloader.

FIG. 29 is a front, end and side view and a perspective illustration of a combination barrel wedge pusher and unloading rod.

FIG. 30 is an exploded view with end views of a barrel sleeve combined with aiming sights.

FIG. 31 is an exploded view with an end view of a an unloading rod and barrel wedge pusher for Colt Model 1861.

The same reference numerals refer to the same parts throughout the various Figures.

DESCRIPTION OF THE PREFERRED EMBODIMENT

Figures 10, 11, 12, 13, 14, 15, 15A, 15B, 15C:
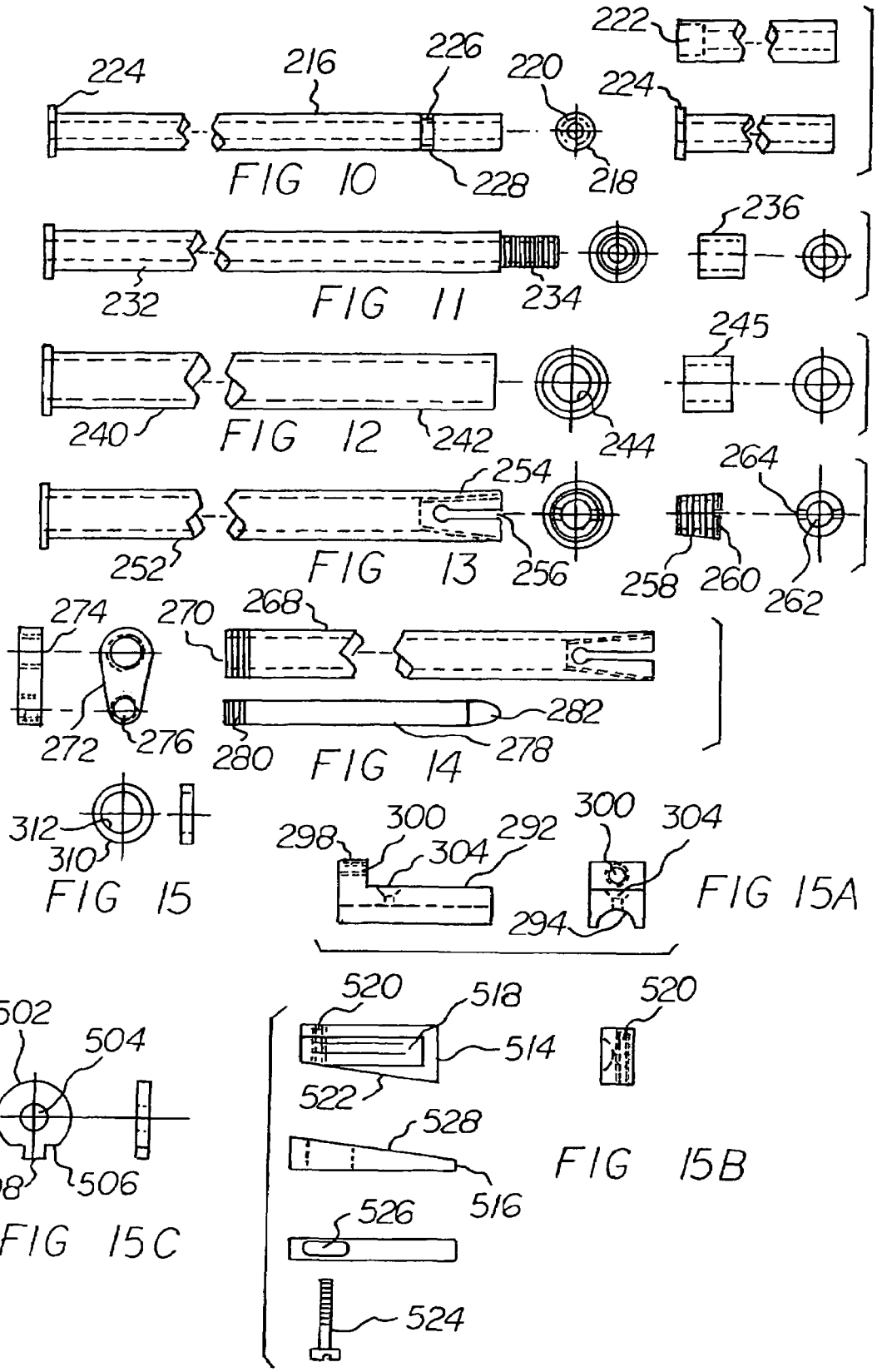
FIGS. 10 through 14 are barrel sleeves constructed in accordance with alternate embodiments.
FIG. 15 is a washer positionable adjacent to the outside diameter of the barrel sleeve.
FIG. 15A is a side elevational view of a bracket an unloading rod to the side of an open top revolver.
FIG. 15B is a top elevational view of an alternate push type two-piece barrel wedge.
FIG. 15C is a side elevational view of a special washer installed under the barrel wedge screw, preventing the barrel wedge from coming out fully.

With reference now to the drawings, and in particular to FIG. 1 thereof, the preferred embodiment of the new and improved firearm conversion system embodying the principles and concepts of the present invention will be described.

The present invention, the firearm conversion system is comprised of a plurality of components. Such components in their broadest context include a pistol, a rotatable cylinder, a firing pin ring, a barrel, and a cartridge extraction tool. Such components are individually configured and correlated with respect to each other so as to attain the desired objective.

The firearm conversion system is for converting a revolver normally loaded with black powder and ball to a revolver for rapidly firing metallic cartridges in a safe, convenient and economical manner. First provided is an open top frame. The open top frame has a central extent 92 with an upwardly extending hammer 36 pivotable forwardly for striking a firing pin 44 to strike and discharge a metallic cartridge 52. The central extent has an operator controlled trigger extending downwardly for initiating movement of the hammer. The central extent has a rearwardly extending handle and a forwardly extending cylindrical shaft 22. The cylindrical shaft has a diametric slot 20 spaced from the central extent with a cylindrical bearing surface between the slot and the central extent.

Next provided is a rotatable cylinder 100. The rotatable cylinder has a central axial aperture mounted on the bearing surface of the cylindrical shaft, the rotatable cylinder having six cylindrical chambers 106 axially oriented and equally spaced around the periphery of the rotatable cylinder.

Next provided is a rotatable firing pin ring 64 having a central axial aperture 62. The firing pin ring is mounted on the bearing surface of the cylindrical shaft between the central extent and the rotatable cylinder. The firing pin ring has six cylindrical bores 68 aligned with the chambers of the rotatable cylinder.

Six firing pins 76 are provided. One firing pin is within each one of the bores and each firing pin is adapted to axially shift when struck by the hammer to strike and discharge one of the metallic cartridges within one of the a chambers of the rotatable cylinder.

A hammer safety lock is provided. It includes a hole in the firing pin ring with a rearwardly extending pin.

Six cylindrical recesses 46 are provided. One of the recesses is within each bore and is in communication with an associated one of the chambers.

Next provided are a metallic cartridges 52. One cartridge is in each chamber. Each cartridge has a forward end removably positioned in one of the chambers and a rearward end removably received within one of the recesses. In this manner, the cartridges will insure concurrent rotation of the cylinder and the firing pin ring during operation and use.

Next provided is a barrel 18 having a central bore with an interior end receiving the cylindrical shaft and an exterior end. The barrel has a diametric slot 16 positionable in alignment with the diametric slot of the cylindrical shaft.

Next provided is a barrel sleeve 40 in a cylindrical configuration. The barrel sleeve is positioned between the barrel and the shaft.

Next provided is a barrel wedge 14. The barrel wedge is movable by a user between an operative orientation and an inoperative orientation. In the operative orientation the barrel wedge is within the slots of the barrel and the shaft for securement purposes. In the inoperative orientation the barrel wedge is removed from the slots for disassembly purposes.

Lastly, a cartridge extraction tool assembly attached to the side of the gun is provided. FIGS. 14, 29, 30 and 32. The cartridge extraction tool is operable with the barrel wedge pulled and with the barrel and barrel sleeve separated from the frame and with the cylinder and firing pin ring axially slid from the cylindrical shaft. This procedure is for an open top gun. For a solid frame gun, the cylinder shaft should be pulled and the gun's barrel does not come off. The cartridge extraction tool is adapted to be sequentially inserted into the chambers of the cylinder from the end remote from the firing pin ring to remove the cartridges after firing in anticipation of reloading the chambers and recesses with new cartridges.

Firearm Caliber Reducer and Conversion System

The present invention is a metallic cartridge caliber reduction converter kit for Civil War era black powder cap and ball revolvers to be used also for cowboy action shooting.

Pushing or pulling mechanically on the gun's barrel wedge so that gun barrel comes off the cylinder shaft, therefore, the cylinder will come off also. This is for loading and unloading of the cartridges, one chamber at a time or being loaded all the chambers at the same time with a quick loader or a plastic or paper throwaway circular cartridge holder. The unloading being done with an unloading device clipped or unclipped on the user's belt.

There are gadgets from the barrel wedge. An unloading rod, open top gun's barrel as described in FIG. 15A and many other ways to attach an unloading rod to the open top gun's barrel The present invention is also a revolver converter—black powder to metallic cartridge with quick loader and unloader—a six component converter for old revolvers, open top or solid frame, including the small frame, "Remington's New Pocket Revolver" which for its small frame will take a special firing pin ring.

Revolvers loaded with black powder and ball will have the caliber reduced and will be converted to metallic cartridges, rim fire or center fire. It is designed for quick loading and unloading of the converted gun. For practice, the economic 22 caliber ammunition can be used and for cowboy action competition, where by rule the smallest caliber is allowed to compete is 32 caliber, the 22 caliber converter can be replaced with a 32 center fire cartridge or all together a converter with a 32 or 22 caliber barrel can be used. One way of doing this is by disassembling the gun in a split second by pulling on the barrel wedge which will remain attached to the gun's barrel. The gun barrel will come off the cylinder shaft and will be held in the left hand. With the same hand is held the gun's cylinder. In the right hand is held the rest of the gun by hooking the trigger guard on one of the fingers. With the same hand, it can be reached for the quick loader placed in a patch clamped to the user's holster belt. Now the cylinder can be loaded, then the gun can be assembled by placing the cylinder on the shaft, then the barrel, and finally pushes the barrel wedge in place to hold the gun in one piece. Now the gun can be fired.

The same order is used to unload the cylinder with a quick unloader clamped also on the user's holster belt. Myself, I am a slow shooter, but using the above system, I can fire 30 rounds in approximately 1 minute 30 seconds, meaning that I load and unload the gun five times. Somebody else might be able to do better time. With this system, the gun always remains in the user's hand for loading and unloading; it never needs to be put down. The six components of the system are as follows:

A) Cylinder—comes in two variations. One is designed to take a firing pin ring with six firing pins and the second is to take a firing pin ring with a single firing pin. There for one variation will have no cavity clearance for the cartridge's rim, but the second variation will have a cavity for the cartridge's rim.

B) Barrel wedge—which can be pushed or pulled mechanically from its location. The pulled type barrel wedge is made in two variations. The first one is a split barrel wedge with a "U" shaped lever. The second is a "U" shaped lever attached to the existing gun's barrel wedge.

C) Barrel sleeve without exposed retaining nut. Barrel sleeve will have an internal holding system which I will describe a few below.

D) Firing pin ring—two variations. First with a single firing pin with or without a safety. Second, six firing pins. Also special firing pin ring for the "Remington's New Pocket Revolver."

E) Quick Loader.

F) Quick Unloader. Solid type and flip up type.

FIG. 1 and FIG. 2 represent a typical open top revolver system 10. Note the open area above the first cylinder 12. Because of its open top, the revolver is held together by a barrel wedge 14 which goes through a first rectangular opening 16 located on the barrel 18 and a second rectangular opening 20 located on the cylinder shaft 22. The barrel wedge in a pulled position, is prevented from coming off the gun's barrel by a barrel wedge retaining screw 24, which is screwed in a threaded hole 26 located above the first rectangular opening.

Generally an open top revolver is firing round balls which are loaded in the first cylinder's chamber 30 together with black powder from the front of the cylinder with a loading lever 32. The back of the chamber in the first cylinder is plugged in by a nipple 34. On the nipple is placed a percussion cap and struck by a hammer 36 to ignite the black powder in the chamber. The explosion created forces the round ball to be pushed out through the gun's barrel. To load such a gun with the above method was time consuming and messy. My six component converter considerably reduces the loading time because an old type black power gun is loaded with metallic cartridges from the back of the first cylinder into the first cylinder's chamber open at both ends. A cowboy action shooter might prefer the new method of loading compared to the old method.

FIG. 2 represents four out of six components of the converter kit:

a basic barrel sleeve 40;

a single firing pin ring 42;

a split barrel wedge; and a second cylinder 44.

These components are attached to the gun. The other two components are:

a quick loader; and a quick unloader.

A. Cylinder

The second cylinder 44 is shown in FIG. 2 and is the same as the first cylinder that uses black powder except that the nipples are machined off. By doing this operation, both ends of the second cylinder's chambers 46 are opened up and can be chambered for metallic cartridges 52 which can be loaded from the back of the cylinder rather than going through the time-consuming procedure of loading from the front, pouring the powder, pushing the ball down with a lever; and putting the percussion cap on the nipples. The ratcheting portion 48 of the second cylinder is not machined off. This allows the cylinder to be rotated, to move an empty chamber out of the way and bring a loaded chamber in line with the barrel. Depending on which variation of the firing pin ring is used, when the 6-pin firing pin ring 50 is used the cylinder will not have a cartridge for a cartridge rim 54. Note in FIG. 2 on the cylinder around the chamber has no cavity. When the single firing pin ring is used on the second cylinder around the chamber will have a cartridge rim cavity 56, the same as the cartridge cavity on the 6-pin firing pin ring. Cavities around the chamber on the cylinder are not pictured. The machined off nipples are replaced by the firing pin ring which is placed over the ratcheting portion of the second cylinder.

B. Firing Pin Ring

The firing pin ring is an extremely simple construction. Basically, it is a washer ¼ inch thick, 1½ inch outside diameter and ⅝ inch inside diameter opening. The outside diameter has a twelve degree angle 60. This is a clearance for the gun's hammer. The inside diameter 62 of the firing pin ring goes over the ratcheting portion in the back of the second cylinder. On the upper part of the firing pin ring is a round firing pin cavity 64 where the firing pin 66 is located. Next to the firing pin cavity there is a threaded hole 68. Into this hole, a button head screw 70 is screwed which overlaps the firing pin cavity and a returning spring 72.

The firing pin tip 76 will protrude out in a hole 78 on the face of the firing pin ring and when it is struck by the hammer it will hit the cartridge's rim, igniting it. The screw 70 will prevent the firing pin from coming out of its location when the hammer is pulled back or cocked.

The bottom of the single firing pin ring has a horizontally machined opening 84 which has the shape of almost a full circle. In this opening will be inserted a horizontal pin 86 which has at the extremes machined a cutout 88. In an alternate embodiment the horizontal pin can also have at the extremes machined all around a groove 90. Either of these shapes form a retention point and have the purpose of preventing the rotation of the firing pin ring when the second cylinder is rotating. The retention points on the horizontal pin will hook left and right on the frame of the gun 92 above a trigger guard 94.

The 6-pin firing pin ring is just as simple construction as the single firing pin ring. The difference is that the 6-pin firing pin ring does not have the horizontal pin with the retention points because it will rotate at the same time as the second cylinder. To be able to do this, the opposite side of the firing pin cavity will have another set of cartridge cavities 56 shown on FIG. 3 about 1/32 inch deep and here will fit in the cartridge rim. This ring will fit the cylinder without any cavity for the cartridge rim as mentioned above. The center line of the firing pin is off center in relation with the cartridge cavity. Because the firing pin has to strike the cartridge rim in order to ignite it, the cartridge cavities practically are indexing points with the cylinder's chambers so the second cylinder will rotate always at the same time with the 6-pin firing pin ring.

On the firing pin ring, the cartridge cavities can be eliminated but in this case there needs to be press-fitted with at least one indexing pin 96 about 3/32 inch in diameter that will couple with an indexing pin cavity 98 about 3/32 inch in diameter and ⅛ inch deep, located on the second cylinder next to the ratcheting portion.

In an alternate embodiment of the present invention, the firing pin ring is adapted to be used as a manual cartridge ejector 100 which has the shape of a washer and a thickness 102 of about 3/32 of an inch. Diagonally, about 1 inch apart, the manual cartridge ejector has two threaded holes 104. There are also six cartridge holes 106 equally divided to match the chamber division on a third cylinder 108. Coupled to each threaded hole there will be a screwed in long indexing pin 110 about ⅛ inch in diameter and 1½ inch long. The long indexing pins on the top has a threaded portion 112 and on the lower part has an internal threaded hole 114. Once the long indexing pins are installed on the firing pin ring with the manual cartridge ejector, they are placed over the ratcheting portion 116 of the third cylinder. In the third cylinder there are two drilled holes 118 with an upper part 120 and a lower part 122 and which have the span of the two threaded holes. The upper part of the holes are about ⅛ inch in diameter and the lower part of the holes are about 3/16 inch in diameter. In these holes are going to fit screws 124 that couple with the long indexing pins. The length of the holes in the third cylinder are longer than the length of the long indexing pins. The screws will prevent the manual cartridge ejector from separating from the third cylinder when it is pulled up and down manually in order to eject the empty cartridges which were loaded into the third cylinder through cartridge holes on the manual cartridge ejector. In the lower end of the drilled holes 122 will fit the head of screws and the length of the lower end will determine the stroke, how much to be pulled up and down the manual cartridge ejector. The manual cartridge ejector has a knurling 126 all around for better finger gripping. The stroke of the manual cartridge ejector is normally the length of an empty cartridge.

A different manual cartridge ejector is adapted to be made of plastic or paper, with the holes being smaller so the cartridge fits in snug. It can be used as a throw away, disposable quick loader. In this case there is no need for the third cylinder to have the drilled holes. Also, there is no need for the long indexing pins and screws. The manual cartridge ejector will be pre-loaded with cartridges and ready to be loaded in the gun's cylinder.

The 6-pin firing pin ring has advantages over the single firing pin ring. The single firing pin ring in some cases comes off the cylinder when it is loaded and unloaded. It also has retention points which have to be lined up with the gun's frame in the event the gun is loaded and assembled which takes time. This also is coming off when the gun is loaded or unloaded, but it gains some loading time because it has no retention points to be lined up with the gun's frame. It just has to be thrown over the ratcheting portion of cylinder and it will index itself with the cylinder's chamber because of the cartridge cavities machined on the face of the 6-pin firing ring. The firing ring basically has six independent firing pins and has no pin return springs.

In cowboy action shooting, every split second is counted. For this reason below I will describe a few more firing pin rings which can save even more loading time and also have safety locks. One way to save more loading time is to keep the firing pin ring attached to the gun's frame constantly, but not permanently. This means that the converter will still remain a removable converter kit. The gun will not have to be defaced or altered in order to install the kit on it. There are several ways to do this. The first would be a firing pin ring constructed with wrap-around bands which also can have safety lock. As a matter of fact, almost all of the firing pin rings described can have a safety lock. The hammer safety lock is a very simple device. It includes a small rearwardly facing pin 69, about 1/16 of an inch in diameter and it is pressed in a hole in the firing pin ring on the right hand side of the firing pin, facing the back of the firing pin ring. At the left hand side, the retention point on the firing pin ring has to be removed. This will allow the firing pin ring to be rotated counterclockwise. Once the center line of the firing pin is out of line with the center line of the hammer, it can be lowered on the safety pin because the hammer has a factory made hole to engage the safety pin. The hammer will rest on the firing pin ring rather than the firing pin itself. Once the hammer is pulled back or cocked, the arm will engage in the ratcheting area of the cylinder and it will rotate it clockwise and so will bring the centerline of the firing pin in line with the center line of the hammer. Gun's that do not have factory drilled holes on the hammer, in that case the hammer has to be lowered next to the safety pin, to the right and the gun will be just as safe because the hammer will rest on the firing pin ring and not on the firing pin. The 6-pin firing pin ring has no retention points in this case, the firing pin ring will have to be equipped with six safety pins which will be located in between the firing pins on the firing pin ring. This will work the same way like the single firing pin ring described above. As you notice on FIG. 1 the basic structure for all firing pin rings is a washer, ¼ inch to 5/16 inch thick by 1½ inch outside diameter by ⅝ inch inside diameter.

An alternate embodiment describing the firing pin rings is shown in FIG. 6 where a third firing pin ring 130 is coupled with a pair of adjacent wrap-around bands 132. One band is a long band 134, and the other band is a short band 136. Each band has a curved region 138 in order to pick up the shape of the frame of the gun 92, shown in FIG. 2. Each band also has a pair of band apertures 140 adapted to allow a pair of band screws 142 to pass through and couple to a pair of corresponding threaded band connector holes 144 on the third firing pin ring. As such, the wrap-around bands will be fastened to the third firing pin ring.

In FIG. 6 notice the bottom of the third firing pin ring has a threaded hole 148 where a screw 150 passes through to form a retention point. This screw will be locked in by a set screw 152 on the opposite side of the threaded hole. Intentionally, only one side of the third firing pin ring has the screw, this way it is permitted to rotate counterclockwise creating the safety lock together with the safety pin 154. On this the hammer will be lowered once the firing pin ring is rotated to face the hammer's striking area with the factory drilled hole to fit the safety pin.

Another alternate embodiment describing the firing pin ring safety lock is shown in FIG. 7. This safety lock also has two wrap-around bands 158, but one of them is constructed in a shape of an angle 160. Having this angle shaped band has the same purpose and works the same as the screw 150 from FIG. 6.

Another alternate embodiment describing a way to keep the firing pin ring attached constantly to the frame of the gun is shown in FIG. 8. In FIG. 8 a fourth firing pin ring 164 in the shape of a washer can be seen having a flattened area 166 across the fourth firing pin ring. Here in centerline with the firing pin 168 are drilled a pair of threaded holes 170 going upwards toward the firing pin. On the flattened area a pair of screws 172 fasten the fourth firing pin ring and a mini vice 174. The mini vice is a piece of rectangular steel 176 having in the middle material removed to form a clearance 178 and having a pair of vice holes 180 allowing the screws to pass through and coupling the mini vice to the fourth firing pin ring. The remaining material is slit 182 forming a bigger component 184 and a smaller component 186. The bigger component having in the center area a threaded vice hole 188 going through where a retention screw 190 couples. The clearance couples onto the frame of the gun 92 shown in FIG. 2. When the set screw is turned, it applies pressure on the smaller component which perform like the jaw of a vice. Then the smaller component is pushed against the frame of the gun and holds the fourth firing pin ring to the gun constantly. This fourth firing pin ring has no safety lock device.

For this reason behind such a firing pin ring can be adapted a safety lock device which has exactly the shape of the firing pin ring described, ½ inch outside diameter and ⅝ inch inside diameter and ¼ inch thickness. The difference is that the device is 1/16 inch thick instead of ¼ inch thick. All gadgets are removed except for the 1/16 inch hammer resting pin and there is an opening for a hammer clearance, not pictured. This will have the same rotating function and safety lock purpose. Instead of rotating the firing pin, the 1/16 inch rotating steel device will be rotated behind the firing pin ring blocking the hammer.

FIG. 9 represents another alternate embodiment of a mini vice attachment for a fifth firing pin ring 194 which has the basic shape of a washer. The fifth firing pin ring has a pair of vice connector cavities 196 at its extremes. Coupled to the vice connector cavities are a pair of hinge jaws 198 each with a pivoting threaded hole 200 which run parallel with the firing pin aperture 202. Each pivoting threaded hole has a matching drilled hole 204 in the vice connector cavity. A pair of first set screws 206 individually pass through each of the matching drilled holes and the pivoting threaded holes, coupling the hinge jaws to the fifth firing pin ring and allowing the hinge jaws to pivot. Parallel to the upper part of the hinge jaw, a threaded vice hole 208 is drilled allowing a second set screw 210 to pass through. By turning the second set screws the mine vice works as described in previous embodiments. By removing the jaw from the left side of the fifth firing pin ring and utilizing a safety pin 212, it will have a safety locking device which works as described in previous embodiments.

C. Barrel Sleeve (Without Exposed Retaining Nut)

The barrel sleeve it is extremely simple device and it is very simple to make. The primary embodiment is a first barrel sleeve 214 made for a 36 caliber block powder revolver made out of a piece of pipe 216 having an outside diameter 218 of .357 inches and an inside diameter 220 drilled for a .22 caliber bullet. The back end of the pipe 222 it is opened up and has a larger diameter of about 3/16 of an inch deep. This area will be flared out with a plumber's tool creating a lip 224 which prevents the first barrel sleeve from being pushed out of the barrel by the pressure created by the propellant explosion. About two inches from the front end of the pipe is a groove 226 that couples to an O-ring 228, keeping the first barrel sleeve snug in the barrel of the revolver.

FIG. 11 represents an alternate embodiment of a second barrel sleeve 232 made for a 36 caliber black powder revolver. It is exactly the same as the first barrel sleeve seen in FIG. 10 except that it does not have the groove for the O-ring. Instead, about two inches of the front end 234 of the second barrel sleeve on the outside diameter is threaded. An elastic rubber cylinder 236 of about ⅜ of an inch long and having an outside diameter slightly larger than the diameter of the second barrel sleeve is pushed on the threaded front end. This will have the same purpose as the O-ring in the primary embodiment, keeping the second barrel sleeve snug on the barrel of the gun.

FIG. 12 represents another alternate embodiment of a third barrel sleeve 240 made for a 44 caliber black powder revolver. It is made the same as the primary embodiment, except that the outside diameter 242 of the third barrel sleeve is 0.440 inches and the inside diameter 244 is 0.357 inches because here will fit the 36 caliber barrel sleeve described by FIG. 11 in previous embodiment. As it can be seen in FIG. 12, the third barrel sleeve has no threaded portion at the front end like the sleeve in FIG. 11 because on the thread from FIG. 11 will be pushed on a rubber cylinder 245 which will have a larger outside diameter, FIG. 12, but the inside diameter will remain the same as the rubber cylinder in FIG. 11. The outside diameter of the cylinder in FIG. 12 is slightly larger than the outside diameter of the sleeve, FIG. 12 and will have the same purpose as the O ring in FIG. 10 and the rubber cylinder FIG. 11.

FIG. 13 represents an alternate embodiment of an internal holding system for a fourth barrel sleeve 252 described by FIG. 10 in a previous embodiment. Instead of the O-ring 228 shown in FIG. 10, the fourth barrel sleeve has an internal tapered thread 254 at the front end of the sleeve having a first slit 256 for expansion. A tapered plug 258 having an external tapered thread 260 is screwed in the internal tapered thread. The tapered plug having a drilled through hole 262 which is always larger than the bullet. The top of the tapered plug having a second slit 264 in order to fit a screwdriver. When the tapered plug is screwed into the internal tapered thread the outside diameter of the fourth barrel sleeve will expand because of the first slit, keeping the fourth barrel sleeve snug in the barrel of the gun.

All the barrel sleeves described in the previous embodiments are made for open top black powder revolvers meaning that the barrel of the gun can be separated from the frame. Therefore, the barrel sleeve can be inserted in the gun barrel from the back end of the barrel. A solid frame black powder revolver is different because the barrel cannot be separated from the frame; therefore, the barrel sleeve has to be inserted from the front end of the barrel of the gun.

FIG. 14 represents an alternate embodiment of a fifth barrel sleeve 268 adapted to couple to a solid frame black powder revolver. Generally, it is same as a barrel sleeve described in previous embodiments for an open top revolver, except that on the back end of the fifth barrel sleeve there is a short threaded area 270 about ⅛ of an inch long. This will be coupled to an oval shaped nut 272. The upper part of the oval shaped nut has a large threaded hole 274 to fit the short threaded area. As depicted in FIG. 30, the upper part of the oval shaped nut is adapted to be made higher so it can be notched in a rectangular shape acting as a sight. The bottom of the oval shaped nut has a small threaded hole 276 where an unloading rod 278 having a threaded back end 280 and a front end 282 in the shape of a bullet is adapted to couple. The unloading rod will stay constantly with the gun but not permanently.

The unloading rod can be used to unload the gun by removing the cylinder pin 286, taking a second cylinder 44 out of the gun, and pulling the loaded cylinder's chamber 46 shown in FIG. 2 over the front end of the unloading rod. This has to be repeated six times to fully unload the gun. The cylinder is adapted to be reloaded and placed back in the frame of the gun 92. The cylinder pin must be pushed back in place to secure the cylinder.

The fifth barrel sleeve can be installed as follows:

holding the oval shaped nut in the frame of the gun;

pushing the fifth barrel sleeve through the barrel of the gun and screwing it in the oval shaped nut;

pushing the fifth barrel sleeve until the nut touches the barrel of the gun; and tightening the tapered plug 258 shown in FIG. 13 until the fifth barrel sleeve is snug in the barrel of the gun.

FIG. 15A represents a bracket which fastens an unloading rod to the side of an open top revolver compared to an unloading rod attached to a solid frame revolver described in a previous embodiment. The L-shaped bracket 292 is made of steel and has on the bottom a half round groove 294 going across horizontally mounting on the lower part 296 of the loading lever 32 and keeping the L-shaped bracket in position. The L-shaped bracket has a step 298 containing a first threaded bracket aperture 300 going parallel to the half round groove. The threaded back end of the unloading rod is adapted to couple to the first threaded bracket aperture. The front end of the unloading rod is adapted to be pointed toward the gun's front sight and also away from the gun's front sight. At the bottom part of the step and above the half round groove there is a second threaded bracket aperture 302 allowing a first hinge pin screw 304 to pass through and fasten the L-shaped bracket to the side of an open top gun. Some guns contain a second hinge pin screw 306 which also can be utilized for the L-shaped bracket assembly.

FIG. 15 represents a washer 310. The internal diameter 312 of the washer is adapted to fit the outside diameter of any barrel sleeve under the lip 224 shown in FIG. 10. The washer is adapted to come in a plurality of thicknesses and sizes in an increments of 0.012 inches having the role of filling the gap between the barrel of the gun and the cylinder. The washer is primarily used because different gun manufacturers have slightly different gun barrel angles. To obtain a reasonable gap of about 0.010-0.015 of an inch in between the barrel with the barrel sleeve in place and the cylinder, the barrel sleeve needs to be shimmed up with the washer. In the event that the caliber reduction can not be achieved by sleeving the gun barrel, in stead of including in the converter kit a barrel sleeve, the whole gun barrel drilled to the desired caliber will be included.

SPECIAL FIRING PIN RING FOR REMINGTON NEW POCKET REVOLVER. ALSO FIRING PIN RINGS FOR SOLID FRAME BLACK POWDER REVOLVER.

Figure 16:
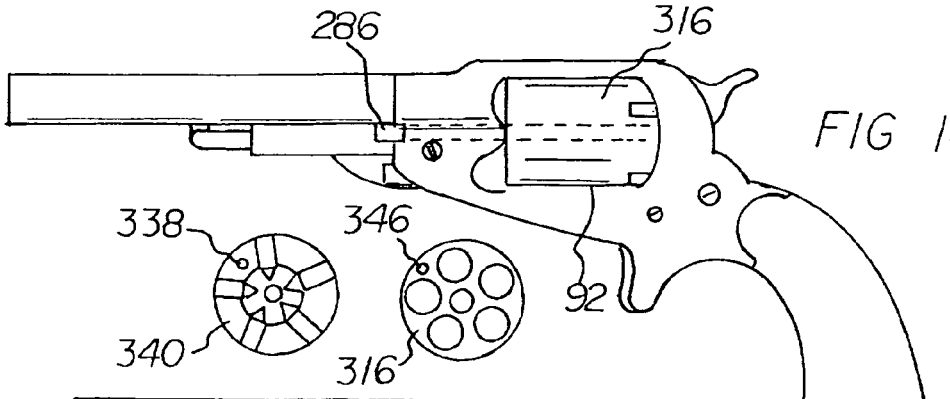
FIG. 16 is a side elevational view of a small frame closed top firearm conversion system constructed in accordance with the principles of the present invention with front elevational views of the cylinder and firing pin ring.
Figure 16A:
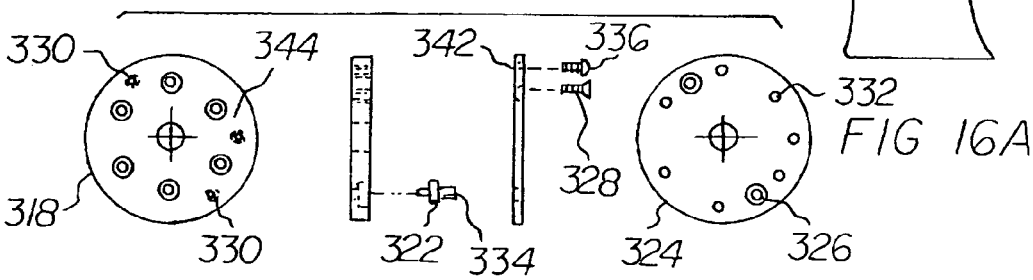
FIG. 16A is an exploded side view and end views of the firing pin ring for Model Remington Small Pocket Revolver of FIG. 16.

In FIG. 16 can be seen a Remington "new pocket revolver" which is a scaled down version of a full size, solid frame Remington. The fourth cylinder 316 is about 1⅛ of an inch in diameter compared with a full size Remington which has a cylinder 1½ inches in diameter. Because of its small size, a sixth firing pin ring 318 will be constructed in a different way. The sixth firing pin ring has the same basic washer shape like the full size solid frame gun, the sixth firing pin ring has a firing pin cavity 320. The firing pin 322 is half of the size compared to a standard firing pin. There is no room for a firing pin retention screw. Instead there is a firing pin cover 324 which has the shape of a very thin washer, about 1/32 of an inch thick. The firing pin cover has a pair of diagonally separated pin cover holes 326. In these pin cover holes there will go through a pair of flat head pin screws 328 which fit a pair of threaded cover holes 330 drilled diagonally on the sixth firing pin ring. The firing pin cover also has a number of small cover holes 332 permitting the firing pin point 334 to protrude out. Once the firing pins are placed in the pin cavities and covered with the firing pin cover allowing the firing pins point protrude out through the small cover holes, the pair of flat head pin screws can be tightened. Like so the sixth firing pin, the firing pins and the firing pin cover will become one single piece.

Next to one of the flat head pin screws is located a button head pin screw 336 which goes through a pin connector hole 338 locate on a factory made second ratcheting portion 340. The button head screw then goes through a connecting cover hole 342 and it is screwed in a threaded connecting pin hole 344. The button head pin screw has to protrude out of the face of the sixth firing pin about 1/16 of an inch. This will be an indexing point which will fit a connecting cylinder hole 346 located on the back of the fourth cylinder in between the chambers. The button head pin screw also holds together the second ratcheting portion with the firing pin cover and the sixth firing pin. The button head pin screw is needed to make sure that the fourth cylinder, the sixth firing pin ring, and the second ratcheting portion rotate at the same time.

Practically, the sixth firing pin ring is sandwiched in between the factory made fourth cylinder and factory made second ratcheting portion.

The difference between the sixth firing pin ring for the Remington new model and the rest of the firing pins described in previous embodiments is that the firing pin ring for this model is sandwiched in between the cylinder and the ratcheting portion, which is separated form the cylinder. The rest of the firing pin rings are directly pulled over the ratcheting portion which is attached to the cylinder.

Figure 17:
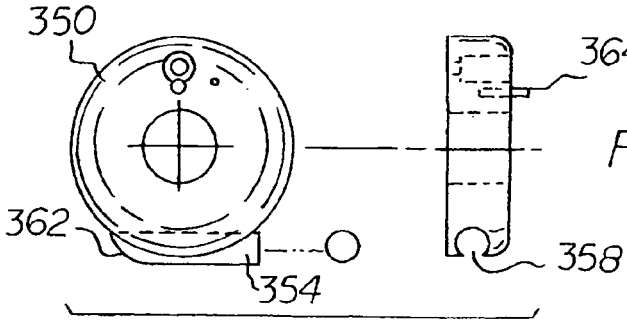
Figure 19:
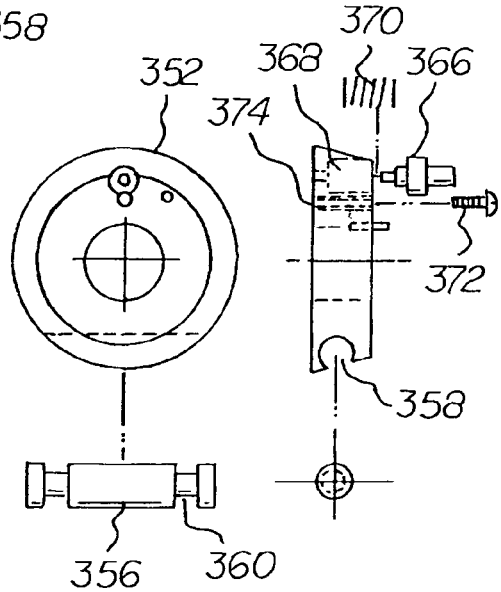

FIG. 17 represents a first solid frame single firing pin ring 350 for a solid frame black powder revolver having the same washer basics as the open top single firing pin ring 352 for an open top black powder revolver. The bottom of the first solid frame single firing pin ring has a first horizontal pin 354. The open top single firing pin ring shown in FIG. 19 has a second horizontal pin 356. The horizontal pins in both types of firing pin rings go through an almost completely circular horizontal pin hole 358. The second horizontal pin of the open top single firing pin ring has at both extremes a groove 360. The grooves create retention points that hook onto the frame of the gun in order to prevent rotation of the open top single firing pin ring when the cylinder of the gun is rotated.

The first solid frame single firing pin ring needs no retention points because it has to be placed directly in the frame of the gun. If it had retention points it would hook onto the frame, making it impossible to place the cylinder in the frame. The open top single firing pin ring is placed on the cylinder shaft while the barrel is removed from the frame of the gun. The first horizontal pin prevents the cylinder from rotating because it sits flat on the frame above the trigger. Also the first horizontal pin on the left had side has a large radius 362 on the left side. This radius will permit the solid frame single firing pin ring from rotating counterclockwise in order to move the safety pin 364 of the hammer safety lock out of center in relation with the center line of the hammer of the gun. To obtain the same thing with the open top single firing pin ring, the groove on the left side has to be removed.

In all of the previous embodiments describing single firing pin rings, common features are present such as a safety pin, a firing pin 366, a firing pin cavity 368, a firing pin return spring 370, a firing pin retaining screw 372, and a firing pin retaining screw hole 374. The 6-pin firing pin rings described in previous embodiments share the same features as the single firing pin ring excluding the firing pin return spring.

The firing pin ring needed for the Remington pocket model is scaled down. On the outside diameter, ring in FIG. 19 has a 12 degree angle which is a clearance for the gun's hammer. On the outside diameter, facing the hammer, the ring in FIG. 17 has a radius which is a clearance in order to fit the radius in the gun's solid frame.

Figure 18:
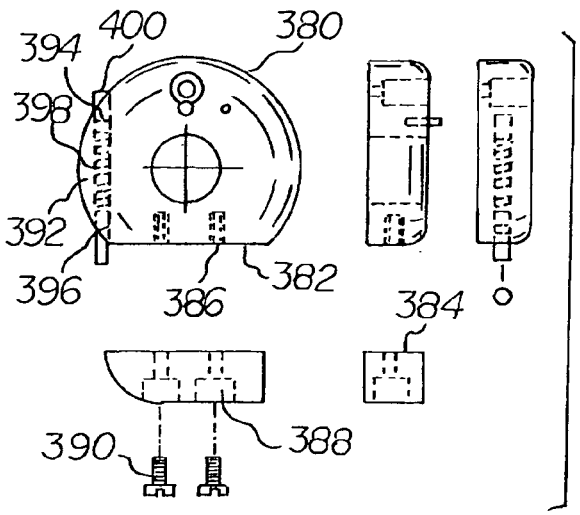

FIG. 18 is an alternate embodiment describing a second solid frame single firing pin ring 380, having a flattened base 382 a rectangular piece of steel 384 replacing the horizontal pin. The piece of steel having the same large radius 362 as shown on the first horizontal pin with the same purpose. Going upright into the flattened base are a pair of threaded base holes 386. The piece of steel also having a pair of threaded upright holes 388 allowing a pair of connector screws 390 to pass through and couple to the threaded base holes, fastening the piece of steel to the second solid frame single firing pin ring. The piece of steel is built to only fit a solid frame gun, distinguishing it from the fourth firing pin ring which only fits an open top gun.

The second solid frame single pin ring has a safety pin device lock 392 which is constructed by drilling a through strap hole 394 on the side and dropping in a shoulder pin 396 which is adapted to stay down by gravity and by the pressure of a light spring 398. The strap hole will be plugged from the top by a set screw 400. The shoulder pin hooks onto the frame of the gun preventing the second solid frame single firing pin ring from being rotated counterclockwise allowing for the safety lock operation to be activated. This basically means that the device does not permit the centerline of the safety pin from moving to the centerline of the face of the hammer.

In order to activate the safety lock operation which brings the safety pin in line with the hammer of the gun, first the shoulder pin has to be unhooked form the frame of the gun by pushing it up with the fingers. Once it is unhooked, it can be released and the second solid frame single firing pin ring can be moved in the safety position. The device lock is mainly for preventing the second solid frame single firing pin ring from moving into a safety mode when such action is not wanted. This device can be adapted to most of the firing pin rings described in previous embodiments. Furthermore, if the device lock is used in pair on a full-shaped washer type firing pin ring 402, FIG. 20, without a flattened base, it can be utilized as retention points because it is retractable and will fit in solid frame revolvers. The pins can be retracted, placed in the frame of the gun, and as it is released the pins will go down hooking onto the frame, thereby preventing the ring from rotating.

D. Barrel Wedge which can be pushed or pulled mechanically from its location and come in two variations: split barrel wedge and a lever attachment for easy pull for the existing factory made wedge.

FIG. 21 shows the primary embodiment of a factory made barrel wedge 406 with a step 408 in the front and an "L" shaped narrow spring blade 410 on the top. The spring blade acts as a hook, preventing the barrel wedge from separating from the frame of the gun when pulled out of its location and hooking in the barrel wedge retaining screw 24 shown in FIG. 2.

FIG. 22 describes an alternate embodiment of an improved barrel wedge 414 having a longer step 416 in order to accommodate a knurled head screw 418. Turning the knurled head screw brings out the improved barrel wedge from its initially tight position until it can be pulled out by hand.

For the barrel wedge in the primary embodiment, the screw operation from the improved barrel wedge is replaced by a lever operated attachment device 422 shown in FIG. 24. It is constructed of a rectangular shaped steel 424 having a rectangular opening 426 in the middle area creating a frame 428. On the frame is installed a "U" shaped lever made of a steel band 430. Both arms having a top aperture 432 where a pair of frame screws 434 are coupled to threaded holes 436 located on the frame of the rectangular piece of steel. Both arms also having a large radius 438 and a small radius 440 above the top aperture. The frame is adapted to be placed around the step of the barrel wedge. Tightening the frame screws applies pressure on the two sides of the barrel wedge, holding it together with the attachment device. The "U" shaped band is adapted to hang downward 442 and pivot 444 along the top aperture. Pulling the bottom of the "U" shaped band in a pivoted position causes the smaller radius to be pressed against the barrel of the gun, pulling the barrel wedge out from its initially tight position until it can be pulled by hand has the same effect as the knurled hand screw.

The spring blade is not always effective, meaning that the barrel wedge retaining screw does not always prevent the barrel wedge from coming out of the barrel. Because of this, a rectangular washer 448, FIG. 25, is needed under the barrel wedge retaining screw. The rectangular washer being made of spring steel and having a width 450 of approximately 1/32 inches. In the central areas of the rectangular washer there is generally rectangular aperture 452 with a tongue 454 hanging down on the upper central area. The rectangular aperture allows the barrel wedge to pass through and the tongue hooks on to the spring blade of the barrel wedge. Above the tongue is a retaining screw aperture 456 that couples to the retaining screw. The rectangular washer acts as an adaptor for the barrel wedge retaining screw in order to have a better grip with the barrel wedge when it is pulled out and when it needs to stay attached to the gun for quick loading and unloading.

An alternate embodiment of an adaptor for the retaining screw is in the shape of a generally circular washer 460 that is 1/4 of an inch high as shown in FIG. 26. The circular washer having a step hole 462 drilled through the center in order to couple to the retaining screw. The circular washer also having a left and right bottom step 464 machined off, leaving a tongue portion 466 in the bottom center area which couples to the spring blade.

FIG. 23 describes an alternate embodiment of a barrel wedge using a split washer 470. It is called a split washer because it is split in the middle forming two rectangular parts, a left part 472 and right part 474. The left part having a top left threaded hole 476, a middle left threaded hole 478, and a bottom left threaded hole 480 each parallel to the top and horizontally going down. The right part having a top right threaded hole 482, and two blind 484 holes that match the middle and bottom left threaded holes. The middle left threaded hole and the bottom left threaded hole are adapted to receive a pair of adjusting set screws 486 that protrude out from the left part and penetrate the two blind holes. Turning the adjusting set screws expands the rectangular parts, creating a solid adjustable split washer barrel wedge which is placed within the barrel of the gun. With the adjusting set screws the wedge is adapted to be adjusted until it fits tight within the barrel. The top left and right threaded holes are adapted to receive a pair of frame screws 488 and couple the split washer to a "U" shaped band 490. The "U" shaped band used to pull the split washer out and for preventing the split washer from coming apart when unwanted.

Looking at FIG. 23 from the top between the adjusting set screws, there is a generally rectangular cavity 492 having a rounded top 494 and a flat bottom 496. The rectangular cavity forms a step 498 and hooking area for the barrel wedge retention screw. The split washer barrel wedge is adapted to use any of the barrel wedge retaining screw adaptor previously described. Because it is a split washer barrel wedge it is adapted to couple to a very small third barrel wedge retaining screw adaptor about 1/4 of an inch high shown in FIG. 27. The third retaining screw adaptor having a hook 467 made of a steel 0-1/32 wire that is placed under the barrel wedge retention screw. The third retention screw adaptor also having a strait part fitting in between the left part and right part of the split washer barrel wedge.

The purpose of a barrel wedge is to keep the barrel tightly secured to the frame of the gun. When an open top or a slid frame black powder cap and ball gun is used to fire lead balls, the gun does not need to be taken apart to be loaded. On the other hand, a converted gun has to be taken apart for loading and unloading; therefore, the barrel wedge needs to tightly stay in its location but also has to be able to be taken out easily. This is why the assistance pulling devices previously described are needed.

FIG. 15C describes an alternate embodiment of a fourth adaptor 500 for the barrel wedge retention screw. The fourth adaptor is a washer 502 about 5/16 of an inch in diameter and 1/16 of an inch thick. The fourth adaptor having a central aperture 504 adapted to receive the barrel wedge retention screw. The fourth adaptor also having a flat bottom 506 and a tongue 508 on the bottom central area. The tongue fitting the steps on the barrel wedge described above or below. The fourth adaptor goes under the head of the barrel wedge retention screw. The fourth adaptor is basically is the same as the second adaptor shown in FIG. 26, but without the step hole which covers the barrel wedge retention screw to give the gun a better look. The purpose for all adaptors are the same, preventing the barrel wedge from coming out of the barrel unwanted.

FIG. 15B represents an alternate embodiment of a fifth barrel wedge having two main parts, a first part 514 and a second part 516. The first part is a rectangular steel about ⅛ of an inch thick. Horizontally it has a half round groove 518 which will not go across. It will bottom out creating a stop at the end of the rectangular steel. The radius in the half round groove is the same as the radius on the head of the barrel wedge retention screw. The stop at the bottom of this groove will hook in the head of the barrel wedge retention screw, preventing it from coming out completely from the barrel of the gun. On one end of the rectangular steel there is an threaded step hole 520. The bottom part of the rectangular steel has a first angle 522 of approximately ½ of a degree. The first part is the primary wedge which is pushed into to barrel first, then the second part of the wedge is pushed in which is the pony wedge being smaller but longer than the primary wedge. Once inserted into the barrel, the two parts are held together by a wedge connector screw 524 which passes through an oval opening 526 located on the side of the second part and screws into the threaded step hole. The second part having a ½ degree second angle 528 but on the upper part which will meet with the first angle. When are pushed against each other the wedge will expand laterally within the barrel, staying in tight.

The fifth barrel wedge is a push in push out wedge because it is pushed in its location and it is pushed out of its location. When inside the barrel the first part and the second part are side by side. The second part being longer and having its back stick out of the barrel. Pushing on the longer part of the second wedge eases up laterally on the whole wedge, permitting it to come out easy. The oval opening regulates the stroke on the second part. Basically by pushing only on the second part in and out, makes the whole wedge to move easy. The fifth barrel wedge is a push in push out type compared to the other embodiments previously described which are push in pull out type wedges.

F. Quick Unloader—FIG. 28

A quick unloader 532 is a washer 534 about the diameter of the cylinder of the gun and is about ¼ of an inch thick. The quick unloader having a central aperture 536 adapted to receive an unloader screw 538. The unloader screw is coupled to a threaded hole 540 located on a long rod 542 that acts as a pilot. The central aperture being surrounded by six threaded holes 544 drilled in a circular configuration on the washer with an equal span to match the chamber span on the cylinder of the gun. In each of the six threaded holes a shorter rod 546 having a threaded end 548 is attached. The long rod having a front 550 in a shape of a bullet. The unloader screw is adapted to attach the quick unloader to a clip, which is adapted to be clamped to the user's holster belt. When on the holster, the cylinder with the empty shells is pulled over then short rod ejects the empty shells all at the same time.

A first mechanical barrel wedge pusher 554 combined with the stationary unloading rod having two parts is described in FIG. 29. The first part is a bracket 558 which holds the second part, an unloader 560 to the side of the gun with a second hinge pin screw 306 shown in FIG. 2. The bracket has a generally rectangular shape with a front end step 562 having drilled across on the extremes two parallel threaded holes 564 adapted to receive a pair of set screws 566. The bracket also having across horizontally a deep groove 568. A flat head groove screw 570 is located toward the back end on the bottom of the deep groove. The groove screw is adapted to be replaced by the second hinge pin screw, holding the bracket to the side of the barrel of the gun. The front end step hooks into the barrel, eliminating rotation around the second hinge pin screw and the pair of the set screws. Tightening the second hinge pin screw will press against the barrel keeping the bracket tight in position. Towards the front end of the bracket, going from a left side 572 to a right side 574 of the deep groove there is an interrupted hole. The left side having a plain hole 576 and the right side having a threaded hole 578. A coupling screw 580 going into the plain hole and then screwed into the threaded hole, coupling the unloader to the bracket.

The unloader is a long rod 582 about three inches long, having a flattened back end 584 adapted to fit in the deep groove and machined to have at the end a hook 586 fitting on the tip of a barrel wedge and in the rectangular opening on the barrel. From the flattened back end to the top of the hook there is an angled side 588 that permits the pushed unloading rod to pivot one way on the coupling screw when it is inserted through aback end hole 590. On the angled side there is a blind hole 592 going up which receives a spring 594. The spring sits on the bottom of the deep groove and brings the unloader to its original horizontal position after the long rod is pulled upward to push the barrel wedge out from a tight position. The long rod is adapted to remove the empty shells from the cylinder of the gun once pulled over it.

FIG. 30 represents a combination unit 598 of a barrel sleeve nut, barrel sleeve, and retaining nut. As may be seen, the barrel sleeve 600 and barrel sleeve nut 602 is combined in one piece machined from a single piece of steel. The barrel sleeve nut having a ⅜ of an inch machined standard dove tail 604 that is fitted with a standard front iron sight and is adapted to also be mounted on the unit with screws. The back of the unit has a short threaded portion 606 that couples to a retaining nut 608. The top of the retaining nut having a notch 610 to serve as for a rear iron sight. Also on this can be machined a ⅜ of an inch dove tail to accept an adjustable rear sight which can be also mounted the same as the front sight. The fifth barrel sleeve shown in FIG. 14 was generally designed for a solid frame revolver, but as it can be seen in FIG. 30, the barrel sleeve can be utilized even more efficiently on an open top frame revolver after a few modifications.

FIG. 31 represents an alternate embodiment showing a second mechanical barrel wedge pusher 614 designed for the open top Colt 1861 model gun made of a rectangular steel block 616. The steel block having a base 618 in the shape of a half pipe fitting the gun's two piece factory made loading arm 32, FIG. 1, and fastened to the gun with a coupling screw. A drilled hole 620 is on the base of the steel block. The steel block also has milled across a deep grove 622 where it fits into a "L" shaped rod 624 having machined across a top groove 626 and a bottom groove 628 in its middle area securing the location of the "L" shaped rod. By pulling on the back 630 of the rod, the front 632 of the "L" shaped rod will go down pushing out the barrel wedge of the gun so that the barrel can be removed.

Pushing or pulling mechanically on the gun's barrel wedge so the gun barrel come off the cylinder shaft, therefore, the cylinder will come off also for loading and unloading of the cartridges, one chamber at the time or being loaded all the chambers at the same time with a quick loader or a plastic or paper throw away circular cartridge holder. The unloading being done with an unloading device clipped or unclipped on the user's belt.

Figure 32:
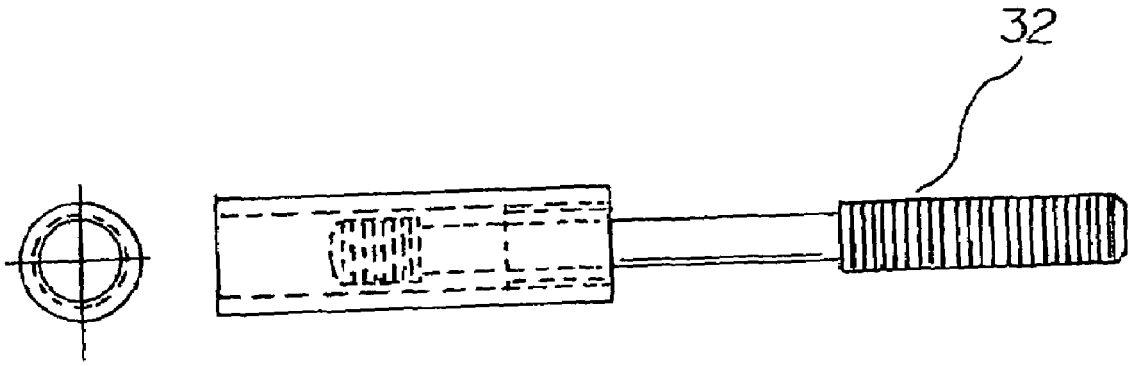
FIG. 32 is a side elevational view, partly in cross section, and an end elevational view of a rectractable unloading rod.

Component 32 as shown in FIGS. 1 and 32 is a retractable unloading rod pressed in the housing of the gun's loading arm after being removed. As it can be seen, it is a ⅜ inch rod about 2 inches long with a 3/16 inch hole across, having the front portion threaded. Here will be screwed in a 10-32 threaded rod having a portion of thread removed. The purpose of this is to speed up the movement of the threaded rod by screwing it when it is extracted or retracted. The bottom of the 10-32 threaded rod is mushroom shaped in order to prevent complete exiting from the plug.

The fixtures mentioned below make a converted gun to fire quicker. It also simplifies the construction.

1. The firing pin ring is fitted with multiple firing pins which require no return spring once stroked by the gun's hammer, then pulled back. The firing pin ring can be fitted on an open top gun or on a solid frame gun. The firing pin ring is indexed with the cylinder by the cartridge's rim except for a small frame solid frame gun which takes a sandwich type firing pin ring indexed with the cylinder by at least one pin.

2. The guns are loaded and unleaded with a quick loader and unloader by removing the gun's cylinder. On the solid frame gun, it is pulled on the cylinder shaft allowing the cylinder to come out. For an open top gun, in order to remove the cylinder, first the gun's barrel has to be removed by pulling or pushing mechanically on the barrel wedge.

3. For loading and unloading, there can be used a stationery unloading rod mounted on the side of the open top gun's frame (barrel) and for the solid frame gun, the stationery unloading rod is part of the barrel sleeve nut. The barrel sleeve nut for an open top gun can be notched in the form of an aiming sight.

4. For open top guns, a single pin firing pin ring remains always with the gun's frame when the cylinder is removed for loading and unloading. A multiple firing pin ring always comes off for loading and unloading on any gun.

5. The open top gun or solid frame gun takes barrel sleeves without a barrel sleeve retaining nut or barrel sleeve with an internal barrel sleeve nut. The nut is not exposed.

6. The open top gun or solid frame gun takes the cylinder and barrel sleeve which converts the gun's ammunition from a black powder cap and ball to a rim or center fired smaller metallic cartridge reducing at the same time the gun's caliber besides just converting it.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A firearm conversion system comprising:

a pistol with a forwardly extending cylindrical shaft having a cylindrical bearing surface;

a rotatable cylinder mounted on the bearing surface with a cylindrical chamber in the rotatable cylinder for receiving a cartridge;

a firing pin ring mounted on the bearing surface with a firing pin aligned with the chamber;

a hammer safety lock including a hole in the firing pin ring with a rearwardly extending pin;

a barrel receiving the cylindrical shaft and a barrel sleeve positioned between the barrel and the shaft; and a cartridge extraction tool operable after axial sliding and separation between the cylinder and the cylindrical shaft, the cartridge extraction tool adapted to be inserted into the a chamber of the cylinder from the end remote from the firing pin ring to remove a cartridge.

2. The system as set forth in claim 1 wherein there is a single chamber and a single firing pin.

3. The system as set forth in claim 1 wherein there are a plurality of chambers and a plurality of aligned firing pins.

4. The system as set forth in claim 1 wherein the pistol is an open top pistol and wherein the cylinder and firing pin ring are axially slid from the shaft for loading and unloading the system further including a cartridge with a forward end positioned in the chamber and a rearward end positioned in the firing pin ring.

5. The system as set forth in claim 1 wherein the pistol is a closed top pistol and wherein the cylinder is axially slid from the shaft for loading and unloading the system further including spring biased fingers removably coupling the firing pin ring to the cylindrical shaft.

6. A firearm conversion system for converting a revolver normally loaded with black powder and ball to a revolver for rapidly firing metallic cartridges in a safe, convenient and economical manner comprising, in combination:

an open top frame having a central extent with an upwardly extending hammer pivotable forwardly for striking a firing pin to strike and discharge a metallic cartridge, the central extent having an operator controlled trigger extending downwardly for initiating movement of the hammer, the central extent having a rearwardly extending handle and a forwardly extending cylindrical shaft, the cylindrical shaft having a diametric slot spaced from the central extent with a cylindrical bearing surface between the slot and the central extent;

a rotatable cylinder having a central axial aperture mounted on the bearing surface of the cylindrical shaft, the rotatable cylinder having six cylindrical chambers axially oriented and equally spaced around the periphery of the rotatable cylinder;

a rotatable firing pin ring having a central axial aperture, the rotatable firing pin ring being mounted on the bearing surface of the cylindrical shaft between the central extent and the rotatable cylinder, the rotatable firing pin ring having six cylindrical bores aligned with the chambers of the rotatable cylinder;

six firing pins, one of the pins being within each one of the bores and each being adapted to axially shift when struck by the hammer to strike and discharge one of the metallic cartridges within one of the chambers of the rotatable cylinder;

a hammer safety lock including a hole in the firing pin ring with a rearwardly extending pin;

six cylindrical recesses, one recess within each bore in communication with an associated one of the chambers;

six metallic cartridges, one cartridge in each chamber, each cartridge having a forward end removably positioned in one of the chambers and a rearward end removably received within one of the recesses whereby the cartridges will insure concurrent rotation of the cylinder and the firing pin ring during operation and use;

a barrel having a central bore with an interior end receiving the cylindrical shaft and an exterior end, the barrel having a diametric slot positionable in alignment with the diametric slot of the cylindrical shaft;

a barrel sleeve in a cylindrical configuration positioned between the barrel and the shaft;

a barrel wedge movable by a user between an operative orientation within the slots of the barrel and the shaft for securement purposes and an inoperative orientation removed from the slots for disassembly purposes; and a cartridge extraction tool operable with the barrel wedge removed and with the barrel and barrel sleeve separated from the frame and with the cylinder and firing pin ring axially slid from the cylindrical shaft, the cartridge extraction adapted to be sequentially inserted into the chambers of the cylinder from the end remote from the firing pin ring to remove the cartridges after firing in anticipation of reloading the chambers and recesses with new cartridges.

* * * * *